United States Patent [19]

Donegan

[11] Patent Number: 4,842,152

[45] Date of Patent: Jun. 27, 1989

[54] SPILL PROOF PLUG

[76] Inventor: James E. Donegan, Rte. 1, Box 97, Aldie, Va. 22001

[21] Appl. No.: 207,657

[22] Filed: Jun. 16, 1988

[51] Int. Cl.[4] ..... B65D 55/16

[52] U.S. Cl. ..... 215/294; 215/306; 220/375; 222/213; 222/495; 222/543

[58] Field of Search ..... 215/294, 306; 220/375; 222/543, 213, 495

[56] References Cited

U.S. PATENT DOCUMENTS 1,408,082 2/1922 Dowler ..... 220/375
3,545,802 12/1970 Rich ..... 215/306 X

FOREIGN PATENT DOCUMENTS 1253868 1/1961 France ..... 220/375

*Primary Examiner*—Donald F. Norton
*Attorney, Agent, or Firm*—Birch, Stewart, Kolasch & Birch

[57] ABSTRACT

Disclosed herein is a one piece spill proof plug which allows a container to be inverted prior to dispensing a fluid to a receiving receptacle. The plug has a plug member, stem and V-shaped retainer members which allow the plug member to snugly fit into the neck portion of a container and allows the biased retainer members to expand within the container. The one piece spill proof plug has many applications, particularly for dispensing motor oil to an engine by way of a valve cover opening.

8 Claims, 1 Drawing Sheet

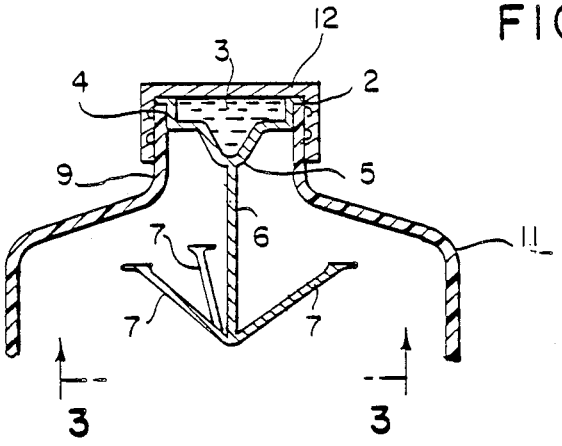
FIG. 1
FIG. 2
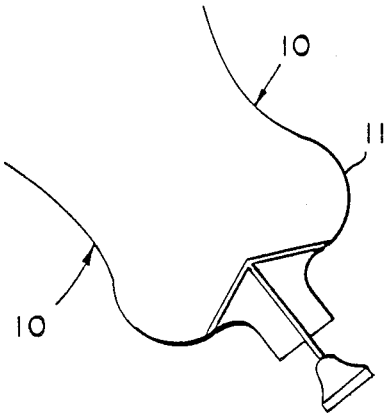
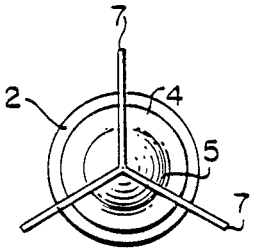
FIG. 3

SPILL PROOF PLUG

The present invention is directed to a one piece spill proof plug which is adapted to fit tightly within the neck of a flexible container.

BACKGROUND OF THE INVENTION

The one piece spill proof plug of the present invention overcomss certain obvious disadvantages associated with dispensing fluids to receptacles requiring first that the container holding the fluid be inverted prior to administering the fluid to the receptacle. Such problems are commonly encountered in receptacles such as radiators, valve cover holes, transmission openings, brake fluid receptacles, power steering fluid receptacles, etc. In the past, attempts have been made to overcome the problems of leakage while inverting the container just prior to dispensing the fluid. Examples of such attempts are (a) using a separate funnel and pouring the fluid into the wider mouth portion of the funnel, and (b) providing longer necks on the containers, such that as the container is inverted the neck can be better aimed at the receptacle opening. These methods have not alleviated the problem of unwanted spilling of the fluids since they still require inverting an open fluid container prior to dispensing the fluid.

Heretofore, various combined stopper or cap/retainers have been known. Examples of such combined stopper or cap/retainers are discussed hereinbelow.

U.S. Pat. No. 351,679 to Wilson discloses an ink bottle having a dipper, with an attached dipper finger or lip to retain said dipper within the ink bottle.

U.S. Pat. No. 721,477 to Tatum discloses a stopper retainer particularly adapted for a hot water bottle. The stopper is a screw top attached to a connecting member, preferably a chain which is attached to a retainer ring. The retainer ring is larger than the opening of the water bottle.

U.S. Pat. No. 876,101 to Schweinhert et al discloses various retainer shapes for use in conjunction with a water bottle stopper. The retainer is made of rigid wire and shaped accordingly.

U.S. Pat. No. 955,441 to Schweinert et al discloses a collapsible ring retainer which is of sufficient elasticity to permit it being forced through the seat of the stopper while it prevents sufficient rigidity to prevent it from escaping under ordinary conditions of use.

U.S. Pat. No. 1,408,082 discloses a safety anchor for a tank which is W-shaped such that the free sides catch the tank at the cylindrical opening thus retaining the anchor and cap.

U.S. Pat. No. 1,543,256 to Grant discloses a vehicle fuel tank cap lock having a float member attached to a collapsible retainer ring wherein the ring is attached via a cable to the tank cap lock.

U.S. Pat. No. 1,481,750 discloses a safety tank cap or stopper having attached thereto a bar or rod of greater diameter of the opening in which the cap or stopper is seated. The bar is provided with cushioning heads to prevent rattling.

U.S. Pat. No. 1,509,796 discloses a cover for gasoline tanks having a T-bar type retainer which is attached via a chain to the gasoline tank cover.

U.S. Pat. No. 2,647,655 to Robinson discloses a tube closure having a chain like part and a semi-spherical retainer attached thereto. The cap is a thread-like type.

U.S. Pat. No. 4,113,138 discloses a liquid tank cap having a vent. The cap is provided with an elongated stem and a traversely extending member which acts as a retainer. The cap retainer can be formed from suitable inexpensive synthetic materials.

None of the references discuss a solution to the problems associated with dispensing a fluid from a container which is in an inverted position such that the fluid can be directed to a receiving receptacle prior to dispensing without concern for undesirable leakage.

SUMMARY OF THE INVENTION

The present invention has been accomplished with the above disadvantages in mind.

The present invention is directed to a one piece spill proof plug adapted to fit tightly within the neck of a container which comprises a plug member and a stem member extending therefrom, one end of the stem member being connected to the plug member, and the other end of the stem member being provided with biased retainer members which extend upwardly therefrom in a configuration larger than the neck portion of a container, whereby as the plug member is being inserted into the neck portion of a container, the retainer members are compressed against their bias but then expand within the container such that when pressure is applied to the outside of the container, the plug is forced from the neck of the container to open the container but is held to and within the container by the bias of the retainer member. The location of the neck on the container is not critical. For example, the neck can be located concentric to the bottle, along a lateral wall or canted.

Other features and advantages of the embodiment of the invention will become apparent to those skilled in the art upon reviewing the following detailed description, the drawings and the appended claims.

BRIEF DESCRIPTION OF THE DRAWINGS

FIG. 1 is a cross-sectional view of a one piece spill proof plug of the present invention in a closed position which is adapted to fit tightly within the neck of a container.

FIG. 2 is a cross-sectional view of a one piece spill proof plug in an open position after the container has been inverted and pressure has been exerted to the side walls of the container.

FIG. 3 is a transectional view along line 3 of FIG. 1 showing an embodiment of the one piece spill proof plug having three biased V-shaped retainer members.

DETAILED DESCRIPTION OF THE INVENTION

Referring to FIG. 1, the one piece spill proof plug comprises a plug member 1 and a stem 6 extending therefrom. The other end of stem 6 is provided with biased retainer members 7 which extend upwardly therefrom in a configuration larger than the neck portion of the container 9. When the plug member 1 is inserted into the neck portion of the container 9, the biased retainer members 7 are compressed against their bias but expand within the containers to their unbiased position thus defining a closed position for the one piece spill proof plug of the present invention. The biased retainer members preferably form a V-shape with the stem.

Referring to FIG. 2, when the container 11 is inverted and pressure is applied to the walls of the container 10, the plug member 1 is forced from the neck of the container 9 but is held to the container by the retainer members 7 resting on the inside wall of the container 10 thus defining an open position for the one piece spill proof plug of the present invention.

Particularly, the one piece spill proof plug of the present invention is made from a flexible material which is substantially inert with respect to the fluid to be dispensed. As an example, if the one piece spill proof plug is to be utilized to dispense motor oil to an engine, the flexible material can be made of the same material utilized in making the actual container. Depending on the fluid to be dispensed other useful materials can be natural or synthetic rubber, silicone type polymers, thermoplastic type polymers, and the like.

The plug member 1 is provided with an outer peripheral portion 2, containment walls 4 and a substantially U-shaped stem alignment portion 5 such that peripheral portion 2, containment wall 4 and stem alignment 5 define a hollow area 3, thus allowing the least amount of pressure to be applied to the walls of the container to force the plug member 1 from the neck of the container 9.

The outer peripheral portion 2 extends radially outward beyond the upper edge of the neck of the container 9 thus preventing the plug member 1 from accidentally entering the container 11, and allowing a cap 12 to be optionally fitted to the neck of the container 9.

The outer diameter of the containment wall 4 is larger than the inner diameter of the neck of the container 9 and is adapted such that the plug member 1 snugly and securely fits within the neck of the container 9 by the application of downward pressure thus preventing the fluid within container 11 from escaping or leaking prior to dispensing. It is to be noted that the outer diameter of containment wall 4 must not be too tight as to prevent the plug member from being forced from the neck of container 9 when inverted and pressure is applied to walls of the container 10. The determination of a suitable outer diameter of containment wall 4 would be readily apparent to those skilled in the art without undue burden and experimentation.

The length of stem 6 is not critical and can be adjusted accordingly depending on the particular length of container neck used in conjunction with the one piece spill proof plug of the invention and/or the depth of open area of the receiving receptacle. For example, when the one piece spill proof plug is to be used in conjunction with a container used for dispensing motor oil to an engine through a valve cover opening, the length of the stem would be such that upon the application of pressure to the walls of container 10 to provide an open position for the spill proof plug, the plug member 1, does not become entrapped or entangled with the engine lifters. In this instance, an example of the length of the stem 6 is such that not more than 1 inch of the one piece spill proof plug distends from the opening of the container.

Referring to FIG. 3, the number of biased V-shaped retainer members 7 is not critical. A particular embodiment provides for three such retainer members 9.

Any conventional method for manufacture of the spill proof plug can be utilized in accordance with the present invention. For instance, compression molding, transfer molding, injection molding, casting, machining, or a combination of these techniques may be utilized to produce the spill proof plug.

Having thus described the invention, the various features of the invention are set forth in the following claims.

What I claim is:

1. A one piece spill proof plug adapted to fit tightly within the neck of a container which comprises, a plug member and a stem member extending therefrom, one end of said stem member being connected to said plug member, and the other end of said stem member being provided with retainer members which extend upwardly therefrom in a configuration larger than said neck portion of a container, whereby as the plug member is being inserted into said neck portion of a container said retainer members are compressed but then expand within said container such that when pressure is applied to the outside of said container, the plug is forced from the neck of the container to open the container but is held to the container by of the retainer member.

2. The one piece spill proof plug according to claim 1 said plug member having an outer peripheral portion extending radially outward.

3. The one piece spill proof plug according to claim 1 wherein said plug member comprises containment walls and a substantially U-shaped portion defining a central hollow portion.

4. The one piece spill proof plug according to claim 1 wherein said stem is of sufficient length to allow fluid within said container to flow outward when said plug is forced from the neck of the container.

5. The one piece spill proof plug according to claim 1 having at least two retainer members.

6. The one piece spill proof plug according to claim 1 wherein said retainer members form a V-shape with the stem.

7. In combination with a flexible container having a neck portion, a one piece spill proof plug adapted to fit tightly within the neck portion of said container comprising a plug member and a stem member extending therefrom, one end of said stem member being connected to said plug member, and the other end of said stem member being provided with retainer members which extend upwardly therefrom in a configuration larger than said neck portion of a container, whereby as the plug member is being inserted into said neck portion of a container, said retainer members are compressed but then expand within said container such that when pressure is applied to the outside of said container, the plug is forced from the neck of the container to open the container but is held to the container by the retainer member.

8. A one piece spill proof plug adapted to fit tightly within the neck of a container which comprises, a plug member having an outer peripheral portion extending radially outward and a stem member extending therefrom, one end of said stem member being connected to said plug member, and the other end of said stem member being provided with biased retainer members which extend upwardly therefrom in a configuraiton larger than said neck portion of a container, whereby as the plug member is being inserted into said neck portion of a container said retainer members are compressed against their bias but then expand within said container such that when pressure is applied to the outside of said container, the plug is forced from the neck of the container to open the container but is held to the container by the bias of the retainer member.

* * * * *